US010016987B2

(12) United States Patent
Katoh

(10) Patent No.: US 10,016,987 B2
(45) Date of Patent: Jul. 10, 2018

(54) IMAGE FORMING METHOD AND IMAGE FORMING SYSTEM

(71) Applicant: Keita Katoh, Kanagawa (JP)

(72) Inventor: Keita Katoh, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/350,479

(22) Filed: Nov. 14, 2016

(65) Prior Publication Data

US 2017/0136785 A1 May 18, 2017

(30) Foreign Application Priority Data

Nov. 17, 2015 (JP) ..... 2015-224817
Oct. 18, 2016 (JP) ..... 2016-204406

(51) Int. Cl.
*B05D 1/02* (2006.01)
*B41J 11/00* (2006.01)
*B41M 7/00* (2006.01)

(52) U.S. Cl.
CPC ..... *B41J 11/0015* (2013.01); *B05D 1/02* (2013.01); *B41M 7/009* (2013.01); *B41M 7/0018* (2013.01)

(58) Field of Classification Search
CPC ..... B41J 11/0015; B41J 1/02; B05D 1/02; B41M 7/0018; B41M 7/009
See application file for complete search history.

(56) References Cited

U.S. PATENT DOCUMENTS

2013/0293617 A1* 11/2013 Suzuki ..... B41J 11/002 347/16
2014/0192121 A1 7/2014 Bannai et al.
2017/0106668 A1* 4/2017 Evers ..... B41J 2/01

FOREIGN PATENT DOCUMENTS

JP 2009-082830 4/2009
JP 2012-213908 11/2012
JP 2014-148159 8/2014

* cited by examiner

*Primary Examiner* — Lamson Nguyen
(74) *Attorney, Agent, or Firm* — Cooper & Dunham LLP

(57) ABSTRACT

An image forming method includes discharging a liquid containing a color material and water onto a surface of a recording medium; performing spray coating to apply a coating liquid containing wax to the surface of the recording medium, the surface having the discharged liquid; and heating the recording medium to which the coating liquid is applied in the spray coating.

19 Claims, 3 Drawing Sheets

IMAGE FORMING METHOD AND IMAGE FORMING SYSTEM

CROSS-REFERENCE TO RELATED APPLICATIONS

The present application claims priorities under 35 U.S.C. § 119 to Japanese Patent Application No. 2015-224817, filed Nov. 17, 2015, and Japanese Patent Application No. 2016-204406, filed Oct. 18, 2016, the contents of which are incorporated herein by reference in their entirety.

BACKGROUND OF THE INVENTION

1. Field of the Invention

The present invention relates to an image forming method and an image forming system.

2. Description of the Related Art

Inkjet recording methods have become widely used due to advantages of a simple process, easiness of full-color printing, and capability of obtaining a high-resolution image with a simplified structure in comparison with other recording methods. Inkjet recording methods have been widespread in fields of personal use, office use, commercial printing, and industrial printing.

In the fields of commercial printing and industrial printing, enamel paper such as coated paper and art paper is used as a recording medium in addition to plain paper. For the enamel paper, image glossiness, a fixing property, and blocking resistance are required in addition to image density.

Aqueous ink is used in many cases because of safety, easiness of handling, and consideration for environment.

Patent Document 1 discloses an image forming method. The image forming method includes applying ink from a discharge head to a recording medium with a movement speed of 200 mm/s or more in a sub-scanning direction between the discharge head and the recording medium, in which an ink composition contains resin-coated pigment having at least a part of pigment particles coated with water-insoluble resin, resin particles, wax particles, 1,2-alkylenediol, polyvalent alcohol, pyrrolidone derivative, and acetylene glycol surfactant; drying the recording medium to which the ink is applied; and stacking dried recording media after attaching powdery materials having an average particle diameter of 1 to 100 μm to the recording media as much as 1 to 1000 mg/m$^2$.

However, there is a demand for improvement of at least one of image density, image glossiness, and blocking resistance in addition to a fixing property.

RELATED ART DOCUMENTS

[Patent Document 1] Japanese Unexamined Patent Application Publication No. 2012-213906

SUMMARY OF THE INVENTION

In an embodiment, an image forming method is provided. The image forming method includes discharging a liquid containing a color material and water onto a surface of a recording medium; performing spray coating to apply a coating liquid containing wax to the surface of the recording medium, the surface having the discharged liquid; and heating the recording medium to which the coating liquid is applied in the spray coating.

BRIEF DESCRIPTION OF THE DRAWINGS

Other objects and further features of embodiments will become apparent from the following detailed description when read in conjunction with the accompanying drawings, in which.

DESCRIPTION OF THE EMBODIMENTS

Figure 1:
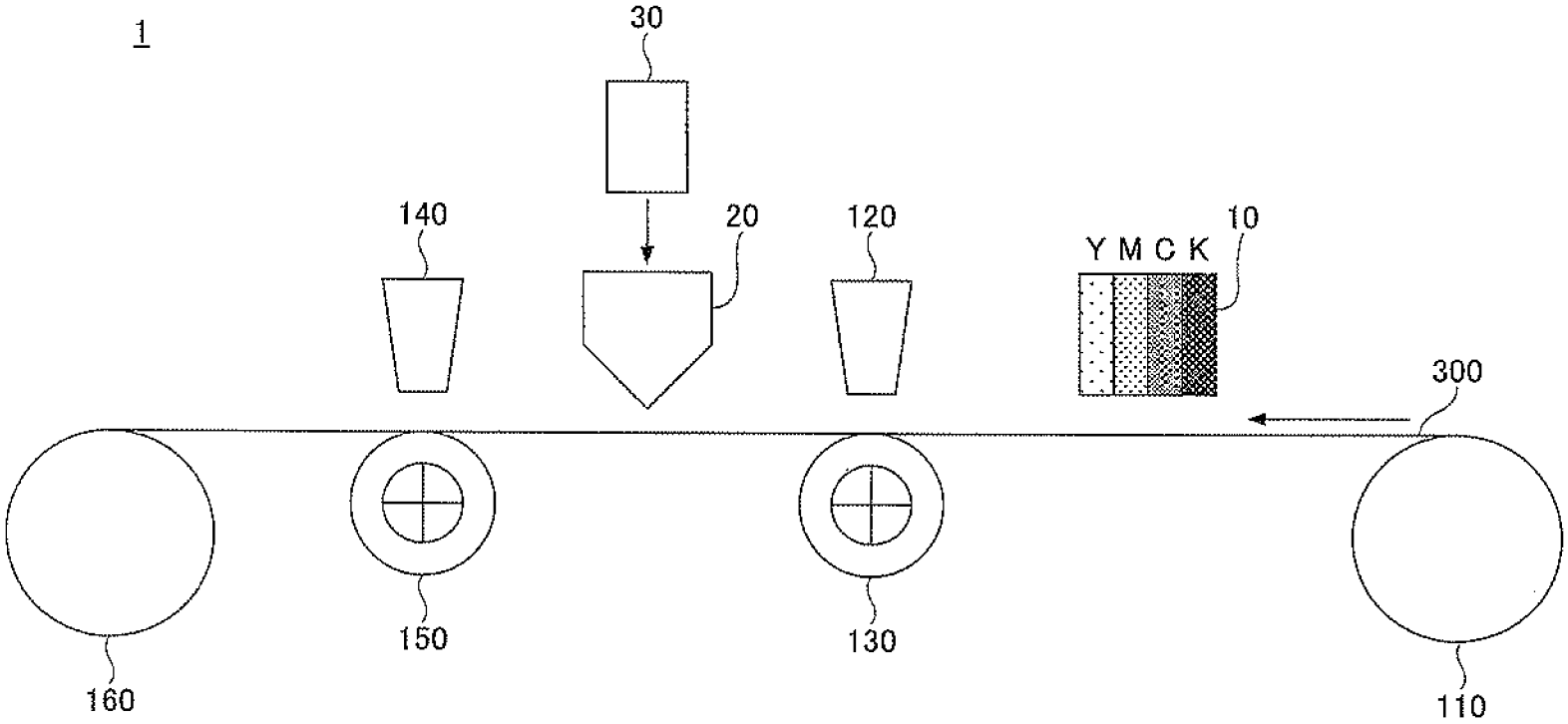
FIG. 1 is a schematic diagram illustrating an image forming device and an image forming method according to an embodiment of the present invention.

In the following, embodiments of the present invention will be described in detail.

It is an object of at least one embodiment of the present invention to provide an image forming method capable of forming an image in which image density, image glossiness, a fixing property, or blocking resistance is improved.

The image forming method includes performing inkjet ejection to apply ink containing a color material and water to a surface of a recording medium; performing spray coating to apply a coating liquid containing wax to the surface of the recording medium, the surface having the ink applied in the inkjet ejection; and heating the recording medium to which the coating liquid is applied in the spray coating.

In this case, by performing the spray coating to apply the coating liquid to the surface of the recording medium, the surface having the ink applied in the inkjet ejection, fine particles of the wax are evenly arranged on a surface layer of the surface of the recording medium, the surface having the ink applied in the inkjet ejection. Further, by heating the recording medium to which the coating liquid is applied in the spray coating, softening or melting of the fine particles of the wax is accelerated and so the surface of the recording medium, the surface having the ink applied in the inkjet ejection, is evenly and thinly coated with the wax. As a result, it is possible to form an image on enamel paper in which image density, image glossiness, a fixing property, and blocking resistance are improved.

It is preferable to heat the recording medium to which the coating liquid is applied in the spray coating, such that the temperature of the recording medium is 0.45 to 1.25 times the temperature of the melting point of the wax. It is more preferable to heat the recording medium to which the coating liquid is applied in the spray coating, such that the temperature of the recording medium is 0.60 to 0.90 times the temperature of the melting point of the wax. By heating the recording medium to which the coating liquid is applied in the spray coating, such that the temperature of the recording medium is equal to or higher than 0.45 times the temperature of the melting point of the wax, it is possible to further improve a fixing property and blocking resistance of an image formed on enamel paper. Further, by heating the recording medium to which the coating liquid is applied in the spray coating, such that the temperature of the recording medium is equal to or less than 1.25 times the temperature of the melting point of the wax, it is possible to further improve image density, glossiness, and a fixing property of an image formed on enamel paper.

The recording medium is not limited in particular. It is possible to use enamel paper such as coated paper and art paper, plain paper, or the like for the recording medium.

<Color Material>

The color material is not limited in particular. It is possible to use pigment and dye as the color material. Of these substances, the pigment is preferably used in terms of image density, a fixing property, and blocking resistance of an image to be formed on enamel paper.

The pigment is not limited in particular. It is preferable to use pigment having at least a kind of anionic hydrophilic group on its surface exhibiting water dispersibility or water solubility. Examples of the pigment exhibiting water dispersibility or water solubility include pigment (1) dispersed by a dispersant having at least a kind of anionic hydrophilic group, pigment (2) coated with resin having at least a kind of anionic hydrophilic group, and pigment (3) bonded to at least a kind of anionic hydrophilic group, an atomic group containing at least a kind of anionic hydrophilic group, or resin having at least a kind of anionic hydrophilic group.

Pigment (1) is generally called pigment dispersed in surfactant or pigment dispersed in resin. The dispersant acts on an interface between the pigment and water, so that the pigment is dispersed in the water.

Pigment (2) is generally called encapsulated pigment. The pigment is coated with water-insoluble resin having an anionic hydrophilic group. The pigment coated with the resin becomes hydrophilic, so that the pigment is dispersed in water.

Pigment (3) is generally called self-dispersed pigment. Carbon black or the like is mainly subjected to surface oxidation treatment to become hydrophilic, so that the pigment is dispersed in water.

The pigment is not limited in particular. The pigment may be selected where necessary depending on a purpose. For example, either inorganic pigment or organic pigment may be used. One of these types of pigments may be used solely or two or more of these types of pigments may be used in combination.

Examples of the inorganic pigment include titanium oxide, iron oxide, calcium carbonate, barium sulfate, aluminum hydroxide, barium yellow, Prussian blue, cadmium red, chrome yellow, metal powder, and carbon black. Of these pigments, the carbon black is preferably used. In addition, the carbon black may be produced in a relevant method such as a contact method, a furnace method, or a thermal method.

Examples of the organic pigment include azo pigment, azomethine pigment, polycyclic pigment, dye chelate, nitro pigment, nitroso pigment, and aniline black. Of these pigments, the azo pigment and the polycyclic pigment are preferably used.

Examples of the azo pigment include azo lake, insoluble azo pigment, condensed azo pigment, and chelate azo pigment. Examples of the polycyclic pigment include phthalocyanine pigment, perylene pigment, perinone pigment, anthraquinone pigment, quinacridone pigment, dioxazine pigment, indigo pigment, thioindigo pigment, isoindolinone pigment, quinophthalone pigment, and rhodamine B lake pigment. Examples of the dye chelate include basic dye chelate and acid dye chelate.

Examples of black pigment include carbon blacks (C.I. pigment black 7) such as furnace black, lampblack, acetylene black, and channel black, metals such as copper, iron (C.I. pigment black 11), and titanium oxide, and organic pigment such as aniline black (C.I. pigment black 1).

Preferably, the carbon black is manufactured by a furnace method or a channel method and has a primary particle size from 15 to 40 nm, a specific surface area as measured by the BET method from 50 to 300 $m^2/g$, an absorbed amount of DBP from 40 to 150 ml/100 g, a volatile content from 0.5 to 10%, and a pH value from 2 to 9.

Commercially available products may be used for the carbon black. Examples of the commercially available products include No. 2300, No. 900, MCF-88, No. 33, No. 40, No. 45, No. 52, MA7, MA8, MA100, and No. 2200B (all of which are manufactured by Mitsubishi Chemical Corporation); Raven 700, Raven 5750, Raven 5250, Raven 5000, Raven 3500, and Raven 1255 (all of which are manufactured by Columbian Chemicals Company); Regal 400R, Regal 330R, Regal 660R, Mogul L, Monarch 700, Monarch 800, Monarch 880, Monarch 900, Monarch 1000, Monarch 1100, Monarch 1300, Monarch 1400 (all of which are manufactured by Cabot Corporation); Color black FW1, Color black FW2, Color black FW2V, Color black FW18, Color black FW200, Color black S150, Color black S160, Color black S170, Printex 35, Printex U, Printex V, Printex 140U, Printex 140V, Special black 6, Special black 5, Special black 4A, and Special black 4 (all of which are manufactured by Degussa Company).

Color pigment that can be used for yellow ink is not limited in particular. The pigment may be selected where necessary depending on a purpose. Examples of the color pigment include C.I. pigment yellow 1, C.I. pigment yellow 2, C.I. pigment yellow 3, C.I. pigment yellow 12, C.I. pigment yellow 13, C.I. pigment yellow 14, C.I. pigment yellow 16, C.I. pigment yellow 17, C.I. pigment yellow 73, C.I. pigment yellow 74, C.I. pigment yellow 75, C.I. pigment yellow 83, C.I. pigment yellow 93, C.I. pigment yellow 95, C.I. pigment yellow 97, C.I. pigment yellow 98, C.I. pigment yellow 114, C.I. pigment yellow 120, C.I. pigment yellow 128, C.I. pigment yellow 129, C.I. pigment yellow 138, C.I. pigment yellow 150, C.I. pigment yellow 151, C.I. pigment yellow 154, C.I. pigment yellow 155, C.I. pigment yellow 174, and C.I. pigment yellow 180.

Color pigment that can be used for magenta ink is not limited in particular. The pigment may be selected where necessary depending on a purpose. Examples of the color pigment include C.I. pigment red 5, C.I. pigment red 7, C.I. pigment red 12, C.I. pigment red 48(Ca), C.I. pigment red 48(Mn), C.I. pigment red 57(Ca), C.I. pigment red 57:1, C.I. pigment red 112, C.I. pigment red 122, C.I. pigment red 123, C.I. pigment red 146, C.I. pigment red 168, C.I. pigment red 176, C.I. pigment red 184, C.I. pigment red 185, C.I. pigment red 202, and pigment violet 19.

Color pigment that can be used for cyan ink is not limited in particular. The pigment may be selected where necessary depending on a purpose. Examples of the color pigment include C.I. pigment blue 1, C.I. pigment blue 2, C.I. pigment blue 3, C.I. pigment blue 15, C.I. pigment blue 15:3, C.I. pigment blue 15:4, C.I. pigment blue 15:34, C.I. pigment blue 16, C.I. pigment blue 22, C.I. pigment blue 60, C.I. pigment blue 63, C.I. pigment blue 66; C.I. vat blue 4, and C.I. vat blue 60.

It is possible to obtain ink having improved color tone and light resistance with a good balance by using the pigment yellow 74 as yellow pigment, the pigment red 122 or the pigment violet 19 as magenta pigment, and the pigment blue 15:3 as cyan pigment.

<Water>

Examples of water include ion-exchanged water, ultrafiltrated water, reverse osmosis water, pure water such as distilled water, highly pure water, and ultrapure water.

Water content in ink is preferably from 20 to 60 mass %.

<Ink>

Ink may further contain, other than a color material and water, organic solvent, surfactant, resin, pH adjuster, antiseptic and antifungal agent, rust-preventive agent, antioxidant, ultraviolet absorber, oxygen absorbent, light stabilizer, or the like where necessary.

When ink is produced, after constituent components are mixed, it is preferable to use a filter, a centrifugal separator, or the like to filter coarse particles and degas the constituent components.

The viscosity of ink at 25° C. is preferably from 5.0 to 15.0 mPa·s and more preferably from 7.0 to 9.0 mPa·s. If the viscosity of the ink at 25° C. is equal to or higher than 5.0 mPa·s, it is possible to further improve a fixing property of an image to be formed on enamel paper. If the viscosity of the ink at 25° C. is equal to or less than 15.0 mPa·s, it is possible to further improve image glossiness of an image to be formed on enamel paper.

When inkjet ejection is performed to apply ink to a recording medium, it is possible to use an inkjet recording device.

<Inkjet Recording Device>

The inkjet recording device includes an ink container and uses a recording head to record an image on a recording medium. The inkjet recording device includes an ink discharging unit to discharge ink and further includes other units such as a stimulus generating unit and a control unit selected where necessary.

The ink discharging unit applies a stimulus to ink to discharge the ink. The ink discharging unit is not limited in particular. Examples of the ink discharging unit include various types of nozzles for ink discharge (see the description of a liquid discharging head 10 for details of the ink discharging unit).

In addition, the control unit is not limited in particular as long as the control unit can control an operation of each unit. The control unit may be selected where necessary depending on a purpose. Examples of the control unit include devices such as a sequencer and a computer.

FIG. 1 is a schematic diagram illustrating an image forming device and an image forming method according to the embodiment of the present invention. An image forming device 1 illustrated in FIG. 1 may be an inkjet recording device. The image forming device 1 includes a liquid discharging head 10 and a spray coating device 20 as main constituent elements.

In the image forming device 1, the liquid discharging head 10, a hot air device 120 and a heating roller 130, the spray coating device 20 and a liquid supplying unit 30, and a hot air device 140 and a heating roller 150 are disposed from upstream relative to a direction (indicated by an arrow) where a recording medium 300 is conveyed.

Figure 2:
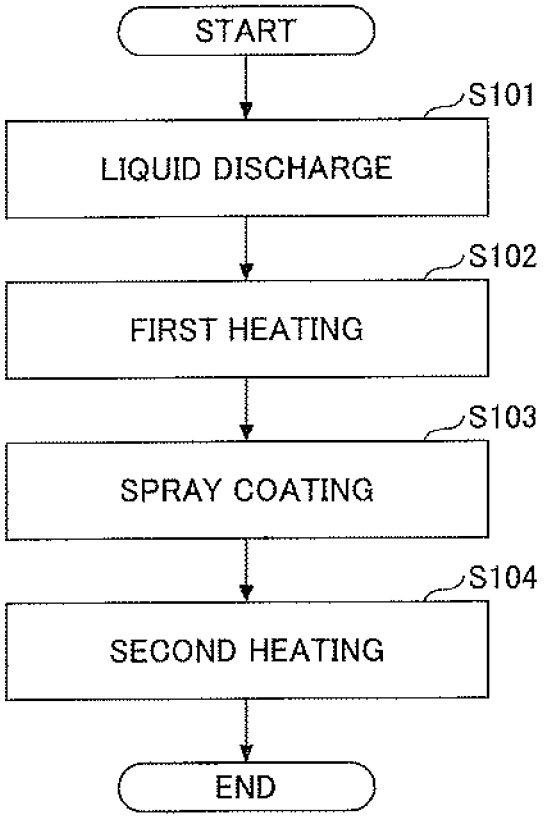
FIG. 2 is a flowchart illustrating an image forming method with use of an image forming device according to an embodiment of the present invention.

FIG. 2 is a flowchart illustrating the image forming method with use of the image forming device 1 according to the embodiment of the present invention. In order to form an image using the image forming device 1, first, in step S101, the liquid discharging head 10 performs ejection to apply (discharge) ink (liquid) containing a color material and water to the recording medium 300 such as enamel paper unwound from an unwinding roller 110 and carried in the direction indicated by the arrow in order to form an image. Details of the liquid discharging head 10 will be described later.

Next, in step S102, the formed image is dried using hot air sent from the hot air device 120 and contact with the heating roller 130 (first heating). Then in step S103, the spray coating device 20 sprays a coating liquid containing a non-volatile component together with a gas (hot air) whose temperature is equal to or higher than a predetermined temperature in order to apply the coating liquid to a surface of the recording medium 300 (spray coating), the surface having the applied ink. In addition, the coating liquid is supplied from the liquid supplying unit 30 to the spray coating device 20. Details of the spray coating device 20 and the liquid supplying unit 30 will be described later.

Then in step S104, the image is dried again using hot air sent from the hot air device 140 and contact with the heating roller 150 (fixing process: second heating). The recording medium 300 is wound up by a winding roller 160 and the image formation ends. In addition, the hot air devices 120 and 140 and the heating rollers 130 and 150 are not essential elements.

In the examples illustrated in FIG. 1 and FIG. 2, the heating processes for heating the recording medium 300 are set both before and after the process by which the spray coating device 20 sprays the coating liquid containing a non-volatile component together with a gas (hot air) whose temperature is equal to or higher than a predetermined temperature in order to apply the coating liquid to the surface of the recording medium 300, the surface having the applied ink. However, the heating process may be set either before or after the process by which the spray coating device 20 performs the spray coating.

By setting the heating process either before or after or both before and after the process by which the spray coating device 20 performs the spray coating, it is possible to further improve the fixing property and block resistance of an image formed on the recording medium 300 such as enamel paper. In particular, it is preferable to set the heating process after the process by which the spray coating device 20 performs the spray coating in that the fixing property and the block resistance of an image can be further improved.

[Liquid Discharging Head]

The liquid discharging head 10 is a unit that applies a stimulus to ink to discharge the ink. The stimulus is not limited in particular and may be selected where necessary depending on a purpose. Examples of the stimulus include heat (temperature), pressure, vibration, and light. One of these types of stimuli may be used solely or two or more of these types of stimuli may be used in combination. Among these types of stimuli, the heat and the pressure are preferable.

Specific examples of the unit include a piezoelectric actuator such as a piezoelectric element, a thermal actuator that uses a phase change resulting from film boiling of liquid by employing an electrothermal converting element such as a heating resistor, a shape-memory alloy actuator using a metal phase change resulting from a temperature change, and an electrostatic actuator using electrostatic force.

A form of ink discharge is not limited in particular. The form may be different depending on a type of stimulus or the like. For example, as a form of ink discharge where a stimulus is heat, a method may be used by which thermal energy corresponding to a recording signal is applied to ink inside the liquid discharging head 10 by using a thermal head or the like, a bubble is generated in the ink from the thermal energy, and pressure of the bubble causes the ink to be discharged or sprayed as a droplet from a nozzle hole of the liquid discharging head 10.

Further, as a form of ink discharge where a stimulus is pressure, a method may be used by which voltage is applied to a piezoelectric element attached to a location called a pressure chamber in an ink channel within the liquid discharging head 10, such that the piezoelectric element is warped and the volume of the pressure chamber is reduced to discharge or spray the ink as a droplet from the nozzle hole of the liquid discharging head 10.

In the example illustrated in FIG. 1, the liquid discharging head 10 is a full-line head. The full-line head is configured with four heads K, C, M, and Y arranged from upstream relative to a direction where the recording medium 300 is conveyed, the four heads K, C, M, and Y being capable of supporting black (K), cyan (C), magenta (M), and Yellow (Y).

<First Heating>

The recording medium 300 to which ink is applied in inkjet ejection may be heated. In accordance with this, it is possible to further improve the fixing property and the blocking resistance of an image formed on enamel paper.

A method for heating the recording medium 300 to which the ink is applied in the inkjet ejection is not limited in particular. Examples of the heating method include a method for bringing a heated fluid into contact with the recording medium 300, a method for heating via heat transfer by bringing a heated object into contact with the recording medium 300, and a method for directly heating the recording medium 300 using energy rays such as infrared rays or far-infrared rays.

<Wax>

Wax may be to an organic substance that is solid at room temperature and becomes liquid when heated. The wax is not limited in particular. It is possible to use wax exhibiting water solubility or water dispersibility. For the water-soluble wax, it is possible to use wax containing a hydrophilic group such as a hydroxyl group, a carboxyl group, an ethylene oxide group, or an amino group. The water-dispersible wax may be mainly used as wax emulsion.

Specific examples of the wax exhibiting water solubility or water dispersibility include vegetable or animal wax such as carnauba wax, candelilla wax, bees wax, rice wax, and lanolin; petroleum wax such as paraffin wax, microcrystalline wax, polyethylene wax, polypropylene wax, oxidized polyethylene wax, and petrolatum; mineral wax such as montan wax and ozokerite; synthetic wax such as carbon wax, Hoechst wax, polyethylene wax, and stearamide; and natural/synthetic wax emulsion or blended wax such as α-olefin/maleic anhydride copolymer. One of these types of wax may be used solely or a plurality of these types of wax may be used in a mixed manner. Further, for the wax exhibiting water solubility or water dispersibility, it is possible to use latex, colloidal solution, suspension, or the like.

Commercially available products may be used for the wax. Specific examples of the commercially available products include Selosol 524 (carnauba wax, melting point: 83° C., particle size: 200 nm, manufactured by CHUKYO YUSHI CO., LTD.), HYTEC E-6500 (polyethylene wax, melting point: 140° C., particle size: 60 nm, manufactured by TOHO Chemical Industry Co., Ltd.), HYTEC E-8237 (polyethylene wax, melting point: 106° C., particle size: 80 nm, manufactured by TOHO Chemical Industry Co., Ltd.), HYTEC P-9018 (polypropylene wax, melting point: 156° C., particle size: 60 nm, manufactured by TOHO Chemical Industry Co., Ltd.), NOPCOTE PEM-177 (polyolefin wax, melting point: 105° C., particle size: 10 nm, manufactured by SAN NOPCO LIMITED), AQUACER 498 (paraffin wax, melting point: 58° C., manufactured by BYK Japan K.K.), AQUACER 535 (mixed wax, melting point: 95° C., manufactured by BYK Japan K.K.), AQUACER 531 (polyethylene wax, melting point: 130° C., particle size: 123 nm, manufactured by BYK Japan K.K.), and AQUACER 515 (polyethylene wax, melting point: 135° C., particle size: 33 nm, manufactured by BYK Japan K.K.)

The melting point of wax is preferably from 70 to 170° C. and more preferably from 100 to 140° C. If the melting point of wax is equal to or higher than 70° C., it is possible to further improve the blocking resistance of an image formed on enamel paper. If the melting point of the wax is equal to or less than 170° C., it is possible to further improve a fixing property of an image formed on enamel paper.

<Coating Liquid>

Preferably, coating liquid further contains resin other than wax. In accordance with this, it is possible to further improve image glossiness and the blocking resistance of an image formed on enamel paper.

It is possible to produce the coating liquid by mixing wax emulsion with resin emulsion, for example.

The coating liquid may further contain, organic solvent, surfactant, pH adjuster, antiseptic and antifungal agent, rust-preventive agent, antioxidant, ultraviolet absorber, oxygen absorbent, light stabilizer, or the like where necessary.

When the coating liquid is applied to the recording medium 300 in spray coating, a spray coating device may be used.

<Spray Coating Device>

Figure 3:
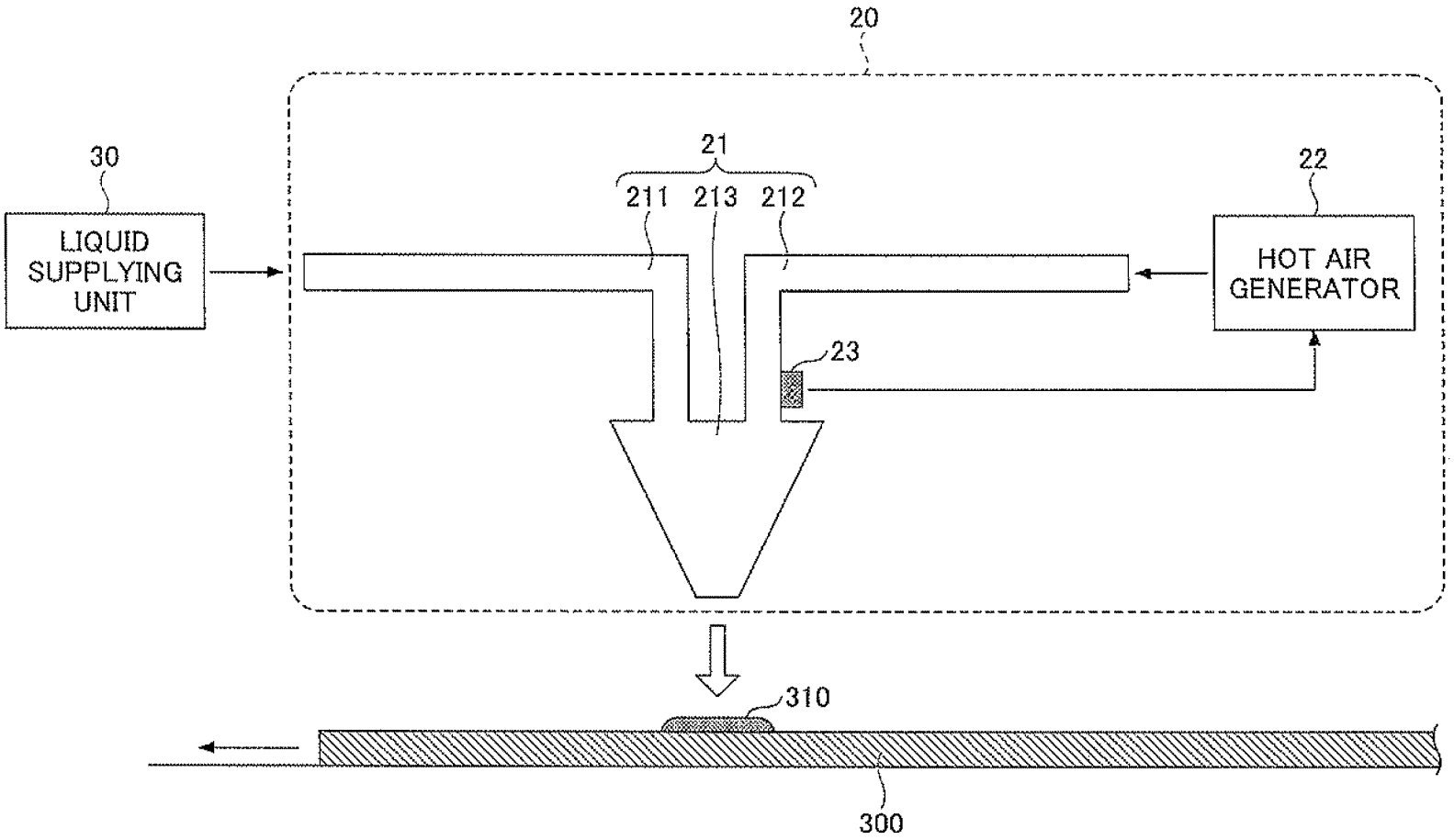
FIG. 3 is a schematic diagram illustrating a spray coating device according to an embodiment of the present invention.

FIG. 3 is a schematic diagram illustrating the spray coating device 20 according to the embodiment of the present invention. As illustrated in FIG. 3, the spray coating device 20 includes a sprayer 21 and a hot air generator 22.

The sprayer 21 includes a liquid introduction path 211 into which a coating liquid is introduced from the liquid supplying unit 30 disposed outside the spray coating device 20, a gas introduction path 212 into which a gas (hot air) whose temperature is predetermined is introduced from the hot air generator 22, and a nozzle 213 for mixing the coating liquid introduced into the liquid introduction path 211 with the gas introduced into the gas introduction path 212 and spraying a resultant mixture.

The hot air generator 22 is a device for generating a gas (hot air) whose temperature is predetermined and introducing a generated gas into the gas introduction path 212. The gas to be introduced into the gas introduction path 212 may be air, nitrogen, or the like. The temperature of the gas to be introduced into the gas introduction path 212 is preferably 50° C. or more to 350° C. or less.

A temperature sensor 23 may be disposed outside in the vicinity of an end of the gas introduction path 212 relative to the nozzle 213. In this case, the temperature sensor 23 senses the temperature of the gas introduced into the gas introduction path 212 immediately before the gas is introduced into the nozzle 213 and outputs a sensing result to the hot air generator 22. A thermocouple may be used for the temperature sensor 23, for example.

The hot air generator 22 controls the temperature of the gas to be introduced into the gas introduction path 212 based on the sensing result sent from the temperature sensor 23. For example, the hot air generator 22 controls the gas to be introduced into the gas introduction path 212 such that the temperature of the gas sensed by the temperature sensor 23 is 50° C. or more to 350° C. or less.

A temperature sensed by the temperature sensor 23 and an (ambient) temperature of an actual gas may be different depending on a system configuration. If the gas is in equilibrium in proximity to the temperature sensor 23 connected to the gas introduction path 212, the temperature sensed by the temperature sensor 23 will be the ambient temperature of the gas. However, depending on a place where the temperature sensor 23 is disposed, the temperature sensed by the temperature sensor 23 and the ambient temperature of the actual gas is assumed to have a temperature difference. In this case, the hot air generator 22 performs temperature control in consideration of the temperature difference as a matter of course.

If the temperature sensor 23 is not disposed, a temperature difference between the temperature of a gas generated by the hot air generator 22 and the temperature of a gas in the vicinity of the end of the gas introduction path 212 relative to the nozzle 213 may be obtained in advance and the hot air generator 22 may generate a gas having a temperature in consideration of the temperature difference. For example, if the temperature difference obtained in advance is 5° C. and the temperature of the gas in the vicinity of the end of the gas introduction path 212 relative to the nozzle 213 is to be set to 50° C., the hot air generator 22 may generate a gas having a temperature of 55° C. and introduce the generated gas into the gas introduction path 212.

The liquid supplying unit 30 introduces a predetermined amount of a coating liquid containing a non-volatile component into the liquid introduction path 211. Examples of a method by which the liquid supplying unit 30 introduces (sends) the coating liquid to the liquid introduction path 211 include a pressure method by which the coating liquid is sent using a pump or a pressure tank and a siphon method by which the coating liquid is sent using a suction effect of gas.

In the example illustrated in FIG. 3, the liquid supplying unit 30 is disposed separately from the spray coating device 20. However, the liquid supplying unit 30 may be included in the spray coating device 20. In this case, the spray coating device 20 is configured to include the sprayer 21, the hot air generator 22, and the liquid supplying unit 30.

Materials for the liquid introduction path 211, the gas introduction path 212, and the nozzle 213 are not limited in particular. Examples of the materials include SUS304, SUS316, brass, iron, aluminum, polypropylene, ABS resin, fluororesin, and rigid polyvinyl chloride.

In FIG. 3, reference numeral 300 indicates a recording medium and reference numeral 310 indicates ink applied to the recording medium 300 by the liquid discharging head 10. The recording medium 300 may be roll paper, for example, and can be conveyed in a direction indicated by an arrow.

The spray coating device 20 mixes, within the nozzle 213, the coating liquid containing the non-volatile component introduced into the liquid introduction path 211 with the gas having a predetermined temperature introduced into the gas introduction path 212 and sprays a resultant mixture from the nozzle 213 toward the ink 310. A distance between a tip of the nozzle 213 and the recording medium 300 is not limited in particular. For example, the distance may be several tens of cm.

For example, it is possible to spray the mixture from the nozzle 213 at a desired time by always introducing the gas having a predetermined temperature into the gas introduction path 212 from the hot air generator 22 and introducing the coating liquid at a predetermined time from the liquid supplying unit 30. A spray pattern of the nozzle 213 is not limited in particular. Examples of the spray pattern include a flat pattern, a full cone pattern, a hollow cone pattern, and a straight pattern.

A spray nozzle of the spray coating device 20 for applying the coating liquid is not limited in particular. Examples of the spray nozzle include a single-fluid nozzle for spraying a coating liquid solely and a two-fluid nozzle (FIG. 3) for mixing the coating liquid with a gas and spraying the a mixture. The two-fluid nozzle is preferable in terms of a fixing property and image density of an image formed on enamel paper.

<Second Heating>

A method for heating the recording medium 300 to which the coating liquid is applied in spray coating is not limited in particular. Examples of the heating method include a method for bringing a heated fluid into contact with the recording medium 300, a method for heating via heat transfer by bringing a heated object into contact with the recording medium 300, and a method for directly heating the recording medium 300 using energy rays such as infrared rays or far-infrared rays.

In addition, the image forming method can be performed using, for example, an image forming system that includes an inkjet recording device for discharging ink containing a color material and water onto a surface of a recording medium 300; a spray coating device for performing spray coating to apply a coating liquid containing wax to the surface of the recording medium 300, the surface having the ink applied in inkjet ejection; and a heating device for heating the recording medium 300 to which the coating liquid is applied in the spray coating.

EXAMPLES

In the following descriptions of examples, parts mean parts by mass.

[Pigment Dispersion PD-1 (Black)]

Carbon black NIPEX 160 (160 parts) (manufactured by Degussa Company) having a BET specific surface area of 150 $m^2/g$, an average primary particle size of 20 nm, a pH value of 4.0, and an absorbed amount of DBP of 620 ml/100 g was premixed with polyoxyethylene (POE) (m=40)-β-naphthyl ether (400 parts) (manufactured by TAKEMOTO OIL & FAT CO., LTD.) and ion-exchanged water (440 parts) to prepare a mixed slurry. The mixed slurry was dispersed in a circulating manner for three minutes at a peripheral speed of 10 m/s and at a liquid temperature of 10° C. by a disc-type media mill DMR (manufactured by Ashizawa Finetech Ltd.) using zirconia beads having a diameter of 0.05 mm (filling ratio: 55%). Then, coarse particles were separated by a centrifugal separator Model-7700 (manufactured by KUBOTA Corporation) to obtain a pigment dispersion PD-1 having a pigment concentration of 16 mass %.

[Pigment Dispersion PD-2 (Cyan)]

A pigment dispersion PD-2 having a pigment concentration of 16 mass % was obtained in the same manner as in the pigment dispersion PD-1 except that the carbon black was changed to pigment blue 15:3 Chromofine Blue (manufactured by Dainichiseika Color & Chemicals Mfg. Co., Ltd.).

[Pigment Dispersion PD-3 (Magenta)]

A pigment dispersion PD-3 having a pigment concentration of 16 mass % was obtained in the same manner as in the pigment dispersion PD-1 except that the carbon black was changed to pigment red 122 Toner Magenta EO02 (manufactured by Clariant).

[Pigment Dispersion PD-4 (Yellow)]

A pigment dispersion PD-4 having a pigment concentration of 16 mass % was obtained in the same manner as in the pigment dispersion PD-1 except that the carbon black was changed to pigment yellow 74 FAST YELLOW 531 (manufactured by Dainichiseika Color & Chemicals Mfg. Co., Ltd.).

[Ink I-1]

The pigment dispersion PD-2 (25.00 parts), 3-ethyl-3-hydroxymethyl oxetane (40.00 parts), silicone surfactant TEGO Wet 270 (2.00 parts) (manufactured by TOMOE KOGYO CO., LTD.), and ion-exchanged water (33.00 parts) were mixed, stirred for one hour, and then filtered with a membrane filter having a pore size of 1.2 μm to obtain an ink I-1.

[Ink I-2]

Dye (cyan) Project Fast Cyan 2 (4.00 parts) (manufactured by Zeneca), 3-ethyl-3-hydroxymethyl oxetane (40.00 parts), and ion-exchanged water (56.00 parts) were mixed, stirred for one hour, and then filtered with a membrane filter having a pore size of 1.2 μm to obtain an ink I-2.

[Ink I-3]

The pigment dispersion PD-1 (50.00 parts), 3-ethyl-3-hydroxymethyl oxetane (30.00 parts), silicone surfactant TEGO Wet 270 (2.00 parts) (manufactured by TOMOE KOGYO CO., LTD.), and ion-exchanged water (18.00 parts) were mixed, stirred for one hour, and then filtered with a membrane filter having a pore size of 1.2 μm to obtain an ink I-3.

[Ink I-4]

An ink I-4 was obtained in the same manner as in the ink I-3 except that the pigment dispersion PD-1 was changed to the pigment dispersion PD-3.

[Ink I-5]

The pigment dispersion PD-4 (25.00 parts), 3-ethyl-3-hydroxymethyl oxetane (20.00 parts), 1,3-butanediol (20.00 parts), silicone surfactant TEGO Wet 270 (2.00 parts) (manufactured by TOMOE KOGYO CO., LTD.), and ion-exchanged water (33.00 parts) were mixed, stirred for one hour, and then filtered with a membrane filter having a pore size of 1.2 μm to obtain an ink I-5.

[Ink I-6]

An ink I-6 was obtained in the same manner as in the ink I-1 except that the added amounts of the pigment dispersion PD-2, the 3-ethyl-3-hydroxymethyl oxetane, and the ion-exchanged water were changed to 20.00 parts, 10.00 parts, and 68.00 parts, respectively.

[Ink I-7]

An ink I-7 was obtained in the same manner as in the ink I-1 except that the 3-ethyl-3-hydroxymethyl oxetane (40.00 parts) was changed to 1,3-butanediol (20.00 parts) and the added amount of the ion-exchanged water was changed to 53.00 parts.

[Ink I-8]

An ink I-8 was obtained in the same manner as in the ink I-1 except that the added amounts of the 3-ethyl-3-hydroxymethyl oxetane and the ion-exchanged water were changed to 50.00 parts and 23.00 parts, respectively.

[Ink-I-9]

An ink I-9 was obtained in the same manner as in the ink I-1 except that the added amounts of the pigment dispersion PD-2, the 3-ethyl-3-hydroxymethyl oxetane, and the ion-exchanged water were changed to 30.00 parts, 65.00 parts, and 3.00 parts, respectively.

Next, the viscosities of the inks were measured.

<Viscosity>

The viscosities of the inks were measured at 25.0° C. using a rotational viscometer RE80L/cone-plate type (manufactured by TOKI SANGYO CO., LTD.). Specific operations are described below. The ink was taken as much as 1.1 mL and was put in a sample cup of the viscometer. Next, the sample cup is installed in a body of the viscometer and was allowed to stand still for one minute. Then a rotor of the viscometer was rotated and a value one minute later was read. In this case, the number of revolutions of the rotor was adjusted such that torque was constant in a range of 40 to 80%.

Table 1 indicates measurement results of the inks.

TABLE 1

| | Color material | | Viscosity |
|---|---|---|---|
| | Type | Color | [mPa · s] |
| I-1 | Pigment | Cyan | 7.8 |
| I-2 | Dye | Cyan | 8.3 |
| I-3 | Pigment | Black | 7.6 |
| I-4 | Pigment | Magenta | 8.0 |
| I-5 | Pigment | Yellow | 8.1 |
| I-6 | Pigment | Cyan | 3.2 |
| I-7 | Pigment | Cyan | 5.0 |
| I-8 | Pigment | Cyan | 15.0 |
| I-9 | Pigment | Cyan | 17.2 |

[Resin Emulsion P-1 (Silicone-Modified Acrylic Resin)]

In a flask including a mechanical stirrer, a thermometer, a nitrogen gas introduction tube, a reflux tube, and a dropping funnel, the inside of the flask was sufficiently replaced with a nitrogen gas. Then pure water (100 g), sodium dodecylbenzenesulfonate (3 g), and polyethylene glycol nonylphenyl ether (1 g) were introduced into the flask, then ammonium persulfate (1 g) and sodium acid sulfite (0.2 g) were added thereto, and the temperature inside the flask was raised to 60° C. Next, a mixture of butyl acrylate (30 g), methyl methacrylate (40 g), butyl methacrylate (19 g), vinylsilanetriol potassium salt (10 g), and 3-methacryloxypropyl methyldimethoxysilane (1 g) was dropped into the flask for 3 hours for polymerization to obtain a resin emulsion P-1. In this case, a polymerization reaction solution was adjusted to have a pH value of 7 with an ammonia aqueous solution in the polymerization. An average particle diameter of the resin emulsion P-1 measured using Microtrack UPA was 160 nm. Further, a solid content concentration of the resin emulsion P-1 was 30 mass %.

[Coating Liquid A-1]

Polyethylene (PE) wax emulsion AQUACER 531 (70.0 parts) having a nonvolatile content of 35 mass % (manufactured by BYK Japan K.K.) and the resin emulsion P-1 (30.0 parts) were mixed and stirred for one hour to obtain a coating liquid A-1. In this case, the PE wax had a melting point of 130° C.

[Coating Liquid A-2]

PE wax emulsion AQUACER 531 (manufactured by BYK Japan K.K.) was used as a coating liquid A-2.

[Coating Liquid A-3]

A coating liquid A-3 was obtained in the same manner as in the coating liquid A-1 except that the PE wax emulsion was changed to modified paraffin wax emulsion AQUACER 537 having a nonvolatile content of 30 mass % (manufactured by BYK Japan K.K.). In this case, the modified paraffin wax had a melting point of 110° C.

[Coating Liquid A-4]

A coating liquid A-4 was obtained in the same manner as in the coating liquid A-1 except that the PE wax emulsion was changed to modified polypropylene (PP) wax emulsion AQUACER 593 having a nonvolatile content of 30 mass %

(manufactured by BYK Japan K.K.). In this case, the modified PP wax had a melting point of 160° C.

Table 2 indicates properties of the coating liquids.

TABLE 2

| | Wax | | |
|---|---|---|---|
| | Type | Melting point [° C.] | Resin |
| A-1 | PE wax | 130 | Yes |
| A-2 | PE wax | 130 | No |
| A-3 | modified paraffin wax | 110 | Yes |
| A-4 | modified PP wax | 160 | Yes |

Example 1

In an environment where a temperature was 23° C. and a relative humidity (RH) was 50%, an inkjet printer IPSiO GX5000 (manufactured by Ricoh Co., Ltd.) was supplied with the ink I-1. Then coating was performed to apply the ink I-1 to a recording medium 300 in order to print a chart where general symbols (64-point font and 128-point font) of JIS X 0208(1997) and 2223 created with Microsoft Word 2000 (manufactured by Microsoft Corporation) were described. In this case, in a user setting for glossy paper in driver software accompanied with the printer, a print mode was changed such that a "Glossy paper-Standard fine" mode had "No color correction" or a "Glossy paper-Standard fast" mode had "No color correction". Further, for the recording medium 300, LumiArt Gloss 90 gsm (manufactured by MONDI Color Copy) (hereafter "coated paper 1") or OK TOP COAT+ having a basis weight of 73.3 g/m$^2$ (manufactured by Oji Paper Co., Ltd) (hereafter "coated paper 2") was used. Further, the general symbols of JIS X 0208(1997) and 2223 had a square outline and the whole area was filled.

After 10 seconds elapsed from completion of the printing, the recording medium 300 was heated by applying hot air to the recording medium 300 for one minute using a dryer. In this case, the speed of the hot air from the dryer was 20 m/s. As a result of this, the temperature of the recording medium 300 during the heating was 100° C. The temperature of the recording medium 300 during the heating was measured by bringing a type K thermocouple having a welded tip and a wire diameter of 0.2 mm (manufactured by ThreeHigh Co., Ltd.) into contact with the recording medium 300.

Further, after one minute elapsed from completion of the heating, coating was performed to apply the coating liquid A-1 to a print surface of the recording medium 300 from a location 30 cm away from the recording medium 300 in the vertical direction, the coating having being performed by sending a compressed air and the coating liquid A-1 to Mini Atomizing Nozzle MMA-10 (manufactured by EVERLOY) which was a two-fluid nozzle serving as a spray nozzle. In this case, a scanning speed of the spray nozzle was adjusted such that an amount of application of the coating liquid A-1 was 100 mg per A4 size.

After two minutes elapsed from the application of the coating liquid A-1, the recording medium 300 was placed on a hot plate NINOS ND-2 (manufactured by AS ONE Corporation) warmed to 100° C. in advance such that a non-print surface was brought into contact with a top plate of the hot plate. Then, the recording medium 300 was heated by applying hot air to the recording medium 300 for one minute using a dryer from above, thereby forming an image. In this case, the speed of the hot air from the dryer was 20 m/s. As a result of this, the temperature of the recording medium 300 during the heating was 100° C.

Example 2

An image was formed in the same manner as in the Example 1 except that in the heating of the recording medium 300 after the application of the coating liquid A-1, the speed of the hot air from the dryer and the warming of the hot plate were reduced such that the temperature of the recording medium 300 during the heating was adjusted to 60° C.

Example 3

An image was formed in the same manner as in the Example 1 except that in the heating of the recording medium 300 after the application of the coating liquid A-1, the speed of the hot air from the dryer and the warming of the hot plate were increased such that the temperature of the recording medium 300 during the heating was adjusted to 160° C.

Examples 4 to 11

Images were formed in the same manner as in the Example 1 except that the inks I-2 to I-9 were used instead of the ink I-1.

Examples 12 to 14

Images were formed in the same manner as in the Example 1 except that the coating liquids A-2 to A-4 were used instead of the coating liquid A-1.

Example 15

An image was formed in the same manner as in the Example 1 except that Hollow-cone Atomizing Nozzle KSN-4A (manufactured by EVERLOY) which was a single-fluid nozzle serving as a spray nozzle was used and only the coating liquid A-1 was sent to the spray nozzle.

Example 16

An image was formed in the same manner as in the Example 1 except that in the heating of the recording medium 300 after the application of the coating liquid A-1, the dryer was not used and only the hot plate was used. The temperature of the recording medium 300 during the heating was 100° C.

Example 17

An image was formed in the same manner as in the Example 1 except that in the heating of the recording medium 300 after the application of the coating liquid A-1, the hot plate was not used and only the dryer was used. The temperature of the recording medium 300 during the heating was 100° C.

Example 18

An image was formed in the same manner as in the Example 1 except that the recording medium 300 was not heated before the application of the coating liquid A-1.

Comparative Example 1

An image was formed in the same manner as in the Example 1 except that the coating liquid A-1 was not applied.

Comparative Example 2

An image was formed in the same manner as in the Example 1 except that the heating was not performed after the application of the coating liquid A-1.

Table 3 indicates conditions of forming an image in the Examples and the Comparative examples.

TABLE 3

| | Ink | Coating liquid | First heating | Spray nozzle | Second heating: Heating method | Second heating: Temperature of recording medium [° C.] | Second heating: Temperature of recording medium/melting point of wax |
|---|---|---|---|---|---|---|---|
| Example 1 | I-1 | A-1 | Yes | Two fluid | Hot plate + hot air | 100 | 0.769 |
| Example 2 | I-1 | A-1 | Yes | Two fluid | Hot plate + hot air | 60 | 0.462 |
| Example 3 | I-1 | A-1 | Yes | Two fluid | Hot plate + hot air | 160 | 1.231 |
| Example 4 | I-2 | A-1 | Yes | Two fluid | Hot plate + hot air | 100 | 0.769 |
| Example 5 | I-3 | A-1 | Yes | Two fluid | Hot plate + hot air | 100 | 0.769 |
| Example 6 | I-4 | A-1 | Yes | Two fluid | Hot plate + hot air | 100 | 0.769 |
| Example 7 | I-5 | A-1 | Yes | Two fluid | Hot plate + hot air | 100 | 0.769 |
| Example 8 | I-6 | A-1 | Yes | Two fluid | Hot plate + hot air | 100 | 0.769 |
| Example 9 | I-7 | A-1 | Yes | Two fluid | Hot plate + hot air | 100 | 0.769 |
| Example 10 | I-8 | A-1 | Yes | Two fluid | Hot plate + hot air | 100 | 0.769 |
| Example 11 | I-9 | A-1 | Yes | Two fluid | Hot plate + hot air | 100 | 0.769 |
| Example 12 | I-1 | A-2 | Yes | Two fluid | Hot plate + hot air | 100 | 0.769 |
| Example 13 | I-1 | A-3 | Yes | Two fluid | Hot plate + hot air | 100 | 0.909 |
| Example 14 | I-1 | A-4 | Yes | Two fluid | Hot plate + hot air | 100 | 0.625 |
| Example 15 | I-1 | A-1 | Yes | Single fluid | Hot plate + hot air | 100 | 0.769 |
| Example 16 | I-1 | A-1 | Yes | Two fluid | Hot plate | 100 | 0.769 |
| Example 17 | I-1 | A-1 | Yes | Two fluid | Hot air | 100 | 0.769 |
| Example 18 | I-1 | A-1 | No | Two fluid | Hot plate + hot air | 100 | 0.769 |
| Comparative example 1 | I-1 | — | — | — | Hot plate + hot air | 100 | — |
| Comparative example 2 | I-1 | A-1 | Yes | Two fluid | — | — | — |

The first heating and the second heating refer to the heating of the recording medium 300 before the coating liquid is applied and the heating of the recording medium 300 after the coating liquid is applied, respectively.

Next, image density, image glossiness, a fixing property, and blocking resistance were evaluated.

<Image Density>

The image density of an area of the recording medium 300 where general symbols (64-point font) were printed was measured using X-Rite 938 (manufactured by X-Rite Inc.). In this case, in the user setting for glossy paper in driver software accompanied with the printer, the print mode was changed such that the "Glossy paper-Standard fine" mode had "No color correction" and the coated paper 1 was used for the recording medium 300.

The image density was determined in accordance with the following evaluation criteria.

[Evaluation Criteria]

Black Ink

AA: 2.00 or more

A: 1.90 or more to 2.00 or less

B: 1.80 or more to 1.90 or less

C: 1.80 or less

Cyan Ink

AA: 2.00 or more

A: 1.90 or more to 2.00 or less

B: 1.80 or more to 1.90 or less

C: 1.80 or less

Magenta Ink

AA: 1.90 or more

A: 1.80 or more to 1.90 or less

B: 1.70 or more to 1.80 or less

C: 1.70 or less

Yellow Ink

AA: 1.00 or more

A: 0.90 or more to 1.00 or less

B: 0.80 or more to 0.90 or less

C: 0.80 or less

<Image Glossiness>

The 60° glossiness of an area of the recording medium 300 where general symbols (128-point font) were printed was measured using handy glossimeter PG-IIM (manufactured by NIPPON DENSHOKU INDUSTRIES CO., LTD.). In this case, in the user setting for glossy paper in driver software accompanied with the printer, the print mode was changed such that the "Glossy paper-Standard fine" mode had "No color correction" and the coated paper 1 was used for the recording medium 300.

The image glossiness was determined in accordance with the following evaluation criteria.

[Evaluation Criteria]

AA: 30 or more

A: 25 or more to 30 or less

B: 20 or more to 25 or less

C: less than 20

<Fixing Property 1>

An area of the recording medium 300 where general symbols (128-point font) of JIS X 0208(1997) and 2223 were printed was rubbed 10 times with a recording medium on which no printing was performed, the recording medium being the same as used for the printing. Then the fixing property was evaluated by visually observing a degree of transfer of pigment to the recording medium on which no printing was performed. In this case, in the user setting for glossy paper in driver software accompanied with the printer, the print mode was changed such that the "Glossy paper-Standard fine" mode had "No color correction" and the coated paper 1 was used for the recording medium 300.

The fixing property was determined in accordance with the following evaluation criteria.

[Evaluation Criteria]

A: Transfer of pigment to the recording medium is hardly seen.

B: Transfer of pigment to the recording medium is slightly seen (an area less than 10% of the entire portion).

C: Transfer of pigment to the recording medium is clearly seen (an area equal to or higher than 10% of the entire portion).

<Fixing Property 2>

The fixing property was evaluated in the same manner as in the fixing property 1 except that the coated paper 2 was used for the recording medium 300.

<Fixing Property 3>

The fixing property was evaluated in the same manner as in the fixing property 1 except that in the user setting for glossy paper in driver software accompanied with the printer, the print mode was changed such that the "Glossy paper-Standard fast" mode had "No color correction".

<Blocking Resistance 1>

An area of the recording medium 300 where general symbols (128-point font) of JIS X 0208(1997) and 2223 were printed was covered, three minutes after an image was formed, with a recording medium (4 cm×4 cm) on which no printing was performed, the recording medium being the same as used for the printing. Then a rubber sheet having a height of 2 cm, a width of 2 cm, and a thickness of 0.2 cm was placed on the center of the recording medium on which no printing was performed. Next, a weight was placed on the rubber sheet such that a pressure applied from the rubber sheet to the recording medium was 0.5 kgf/cm$^2$ and the weight was allowed to stand for 12 hours in an environment where a temperature was 23° C. and an RH was 50%. Then the superposed recording medium was removed and the blocking resistance was evaluated by visually observing a degree of transfer of pigment to the recording medium on which no printing was performed. In this case, in the user setting for glossy paper in driver software accompanied with the printer, the print mode was changed such that the "Glossy paper-Standard fine" mode had "No color correction" and the coated paper 1 was used for the recording medium 300.

The blocking resistance was determined in accordance with the following evaluation criteria.

[Evaluation Criteria]

A: Transfer of pigment to the recording medium is hardly seen.

B: Transfer of pigment to the recording medium is slightly seen (an area less than 10% of the entire portion).

C: Transfer of pigment to the recording medium is clearly seen (an area equal to or higher than 10% of the entire portion).

<Blocking Resistance 2>

The blocking resistance was evaluated in the same manner as in the blocking resistance 1 except that the coated paper 2 was used for the recording medium 300.

Table 4 indicates evaluation results of the image density, the image glossiness, the fixing property, and the blocking resistance.

TABLE 4

| | Image | | Fixing property | | | | |
|---|---|---|---|---|---|---|---|
| | Image density Normal printing | glossiness Normal printing | Normal printing | | High-speed printing | Blocking resistance Normal printing | |
| | Coated paper 1 | Coated paper 1 | Coated paper 1 | Coated paper 2 | Coated paper 1 | Coated paper 1 | Coated paper 2 |
| Example 1 | AA | AA | A | A | A | A | A |
| Example 2 | AA | AA | A | A | B | A | A |
| Example 3 | AA | A | A | A | A | A | A |
| Example 4 | B | A | A | B | B | A | B |
| Example 5 | AA | AA | A | A | A | A | A |
| Example 6 | AA | AA | A | A | A | A | A |
| Example 7 | AA | AA | A | A | A | A | A |
| Example 8 | A | AA | B | B | A | A | A |
| Example 9 | A | AA | A | B | A | A | A |
| Example 10 | AA | A | A | A | A | A | B |
| Example 11 | AA | B | A | A | A | A | B |
| Example 12 | A | B | A | A | A | A | B |
| Example 13 | AA | AA | A | B | A | A | A |
| Example 14 | AA | AA | A | A | A | A | B |
| Example 15 | A | A | A | B | B | B | B |
| Example 16 | B | B | A | B | B | B | B |
| Example 17 | AA | AA | A | A | B | A | A |
| Example 18 | A | A | A | B | B | A | B |
| Comparative example 1 | C | C | C | C | C | C | C |
| Comparative example 2 | B | B | B | C | C | B | C |

From Table 4, it is understood that in the Examples 1-18, it is possible to form an image on coated paper in which the image density, the image glossiness, the fixing property, and the blocking resistance are improved.

By contrast, in the Comparative example 1, because the coating liquid A-1 is not applied, the image density, the image glossiness, the fixing property, and the blocking resistance of an image formed on coated paper are not improved.

Further, the in the Comparative example 2, because the heating is not performed after the application of the coating liquid A-1, the fixing property of an image formed on the coated paper 1 in the high-speed printing and the fixing property and the blocking resistance of an image formed on the coated paper 2 in the normal printing are not improved.

According to an embodiment of the present invention, it is possible to provide an image forming method capable of forming an image in which the image density, the image glossiness, the fixing property, or the blocking resistance is improved.

Further, the present invention is not limited to these embodiments, and various variations and modifications may be made without departing from the scope of the present invention.

What is claimed is:

1. An image forming method comprising:

discharging a liquid containing a color material and water onto a surface of a recording medium;

performing spray coating using a two-fluid nozzle to apply a coating liquid containing wax to the surface of the recording medium, the surface bearing the discharged liquid containing the color material and the water; and heating the recording medium to which the coating liquid is applied in the spray coating.

2. The image forming method according to claim 1, wherein the heating includes applying hot air to the recording medium to which the coating liquid is applied in the spray coating.

3. The image forming method according to claim 1, further comprising:

heating the recording medium onto which the liquid is discharged, wherein the spray coating is performed to apply the coating liquid to the surface of the heated recording medium, the surface having the discharged liquid.

4. The image forming method according to claim 1, wherein the color material is pigment.

5. The image forming method according to claim 1, wherein the coating liquid further contains resin.

6. The image forming method according to claim 1, wherein viscosity of the liquid containing the color material and the water at 25.0° C. is 5 mPa·s or more to 15 mPa·s or less.

7. An image forming method comprising:

discharging a liquid containing a color material and water onto a surface of a recording medium;

performing spray coating to apply a coating liquid containing wax to the surface of the recording medium, the surface having the discharged liquid; and heating the recording medium to which the coating liquid is applied in the spray coating, to a temperature not less than 0.45 times a temperature of a melting point of the wax and not higher than 1.25 times the temperature of the melting point of the wax.

8. The image forming method according to claim 7, wherein a two-fluid nozzle is used to perform the spray coating to apply the coating liquid.

9. The image forming method according to claim 7, further comprising:

heating the recording medium onto which the liquid is discharged, wherein the spray coating is performed to apply the coating liquid to the surface of the heated recording medium, the surface having the discharged liquid.

10. The image forming method according to claim 7, wherein the color material is pigment.

11. The image forming method according to claim 7, wherein the coating liquid further contains resin.

12. The image forming method according to claim 7, wherein viscosity of the liquid containing the color material and the water at 25.0° C. is 5 mPa·s or more to 15 mPa·s or less.

13. An image forming system comprising:

a liquid discharging unit configured to discharge a liquid containing a color material and water onto a surface of a recording medium;

a spray coating unit configured to perform spray coating and including a two-fluid nozzle to apply a coating liquid containing wax to the surface of the recording medium, the surface bearing the discharged liquid; and a heating unit configured to heat the recording medium to which the coating liquid is applied in the spray coating.

14. The image forming system according to claim 13, wherein the spray coating unit further includes:

an air generator to supply a gas, heated to a predetermined temperature and introduced via a gas introduction path, to the two-fluid nozzle; and a liquid supplying unit to supply a source liquid that includes the wax and introduced via a liquid introduction path, to the two-fluid nozzle, wherein the two-fluid nozzle mixes the source liquid and the gas to form the coating liquid which is applied to the surface of the recording medium bearing the discharged liquid.

15. The image forming system according to claim 13, wherein the recording medium to which the coating liquid is applied in the spray coating is heated by the heating unit to a temperature not less than 0.45 times a temperature of a melting point of the wax and not higher than 1.25 times the temperature of the melting point of the wax.

16. The image forming system according to claim 13, wherein viscosity of the liquid containing the color material and the water at 25.0° C. is 5 mPa·s or more to 15 mPa·s or less.

17. An image forming method comprising:

(a) discharging a liquid containing a color material and water onto a surface of a recording medium;

(b) heating the recording medium onto which the liquid was discharged in (a);

(c) performing spray coating to apply a coating liquid containing wax to the surface of the recording medium that was heated in (b) and to which the liquid was discharged in (a); and (d) heating the recording medium to which the coating liquid was applied by the spray coating in (c).

18. The image forming method according to claim 17, wherein the recording medium to which the coating liquid is applied in the spray coating is heated such that a temperature of the recording medium is not less than 0.45 times a temperature of a melting point of the wax and is not higher than 1.25 times the temperature of the melting point of the wax.

19. The image forming method according to claim 17, wherein the heating includes applying hot air to the recording medium to which the coating liquid is applied in the spray coating.

* * * * *